US007887466B1

(12) United States Patent
Chen

(10) Patent No.: US 7,887,466 B1
(45) Date of Patent: Feb. 15, 2011

(54) TREADMILL HAVING VENTILATING FAN DEVICE

(76) Inventor: Paul Chen, 7771 Goldstream Dr., Richmond, Vancouver, BC (CA) V7A 1S5

( * ) Notice: Subject to any disclaimer, the term of this patent is extended or adjusted under 35 U.S.C. 154(b) by 0 days.

(21) Appl. No.: 12/802,553

(22) Filed: Jun. 9, 2010

(51) Int. Cl.
*A63B 22/02* (2006.01)

(52) U.S. Cl. ..... 482/54

(58) Field of Classification Search ..... 482/51, 482/54, 148
See application file for complete search history.

(56) References Cited

U.S. PATENT DOCUMENTS

| | | | | | |
|---|---|---|---|---|---|
| 931,394 | A * | 8/1909 | Day | 482/54 |
| 3,659,845 | A * | 5/1972 | Quinton | 482/7 |
| 3,809,003 | A * | 5/1974 | Foldvari | 440/29 |
| 4,151,988 | A * | 5/1979 | Nabinger | 482/54 |
| 4,659,074 | A | 4/1987 | Taitel et al. | |
| 5,102,380 | A * | 4/1992 | Jacobson et al. | 482/54 |
| 5,104,120 | A | 4/1992 | Watterson et al. | |
| 5,437,588 | A * | 8/1995 | Abboudi et al. | 482/54 |
| 5,665,032 | A * | 9/1997 | Chen | 482/54 |
| 5,897,460 | A * | 4/1999 | McBride et al. | 482/54 |
| 6,190,289 | B1 * | 2/2001 | Pyles et al. | 482/52 |
| 6,300,694 | B1 | 10/2001 | Wang et al. | |
| 6,461,279 | B1 | 10/2002 | Kuo | |
| 6,478,720 | B1 * | 11/2002 | Barker | 482/54 |
| 6,846,274 | B2 * | 1/2005 | Lopez-Santillana et al. | 482/54 |
| 6,878,099 | B2 * | 4/2005 | Corbalis et al. | 482/54 |
| 6,942,602 | B1 * | 9/2005 | Barker | 482/54 |
| 7,367,926 | B2 * | 5/2008 | Clark | 482/54 |

* cited by examiner

*Primary Examiner*—Steve R Crow
(74) *Attorney, Agent, or Firm*—Charles E. Baxley

(57) ABSTRACT

A treadmill includes a drive roller disposed in a tread base, a treadmill belt engaged with the drive roller, and a wheel attached to the drive roller and rotated in concert with the drive roller, and an electric generating device is attached to the tread base and includes a fan device attached to a spindle, and the spindle is engaged with the wheel for allowing the spindle of the electric generating device to be driven and rotated by the wheel and the drive roller and the treadmill belt in order to generate the electric energy, and the fan device is also to be driven and rotated by the wheel and the drive roller and the treadmill belt without the other electric energy, in order to generate the circulating or ventilating air to cool the user.

5 Claims, 7 Drawing Sheets

TREADMILL HAVING VENTILATING FAN DEVICE

BACKGROUND OF THE INVENTION

1. Field of the Invention

The present invention relates to a treadmill, and more particularly to a treadmill including a cooling or ventilating fan device driven or rotated or powered by the user without the other electric energy and including an electric generating device for generating an electric energy to power or energize the other electric parts or elements or facilities of the treadmill.

2. Description of the Prior Art

Typical treadmills comprise a number of support rollers pivotally or rotatably attached or mounted in a tread base and attached or mounted between a pair of mounting rails for pivotally or rotatably supporting the treadmill belt, and a brake device attached to the flywheel assembly for braking the support rollers or the treadmill belt.

For example, U.S. Pat. No. 4,659,074 Taitel et al. discloses one of the typical passive type treadmills having an improved governor assembly and also comprising a treadmill belt pivotally or rotatably supported around support rollers for being actuated or operated or rotated or powered around the support rollers by the user.

However, the rotational movement of the support rollers and the treadmill belt has not been suitably used to drive or rotate the other electric parts or elements or facilities of the treadmill, and the typical passive type treadmills have no cooling or ventilating fan devices for generating a circulating or ventilating air to suitably cool the user.

U.S. Pat. No. 5,104,120 to Watterson et al. discloses another typical exercise machine control system comprising a treadmill belt pivotally or rotatably supported around support rollers for being actuated or operated or rotated or powered around the support rollers by the user, and a motor to rotate or drive or propel the treadmill belt.

However, an electric energy is required to be provided and supplied to the motor in order to actuate the motor to rotate or drive or propel the treadmill belt. Similarly, the rotational movement of the support rollers and the treadmill belt has not been suitably used to drive or rotate the other electric parts or elements or facilities of the treadmill, and the typical treadmills or exercise machines have no cooling or ventilating fan devices for generating a circulating or ventilating air to suitably cool the user.

U.S. Pat. No. 6,300,694 to Wang et al. discloses a further typical exercise machine having a cooling fan for electric treadmill motor and comprising a treadmill motor for rotating or driving or propelling the treadmill belt, and another independently running motor for driving or rotating an induced draft fan and for cooling the treadmill motor.

However, an electric energy is required to be provided and supplied to both the treadmill motor and the independently running motor in order to actuate the treadmill motor to rotate or drive or propel the treadmill belt, and to actuate the independently running motor to drive or rotate the induced draft fan.

Similarly, the rotational movement of the support rollers and the treadmill belt has not been suitably used to drive or rotate the other electric parts or elements or facilities of the treadmill, and the typical treadmills or exercise machines have no cooling or ventilating fan devices for generating a circulating or ventilating air to suitably cool the user.

U.S. Pat. No. 6,461,279 to Kuo discloses a still further typical treadmill having dual treads for stepping exercises and comprising a treadmill motor for rotating or driving or propelling the treadmill belt.

However, an electric energy is required to be provided and supplied to the treadmill motor in order to actuate the treadmill motor to rotate or drive or propel the treadmill belt.

Similarly, the rotational movement of the support rollers and the treadmill belt has not been suitably used to drive or rotate the other electric parts or elements or facilities of the treadmill, and the typical treadmills or exercise machines have no cooling or ventilating fan devices for generating a circulating or ventilating air to suitably cool the user.

The present invention has arisen to mitigate and/or obviate the afore-described disadvantages of the conventional treadmills or exerciser devices.

SUMMARY OF THE INVENTION

The primary objective of the present invention is to provide a treadmill including a cooling or ventilating fan device driven or rotated or powered or actuated or operated by the user without the other electric energy.

The other objective of the present invention is to provide a treadmill including an electric generating device for generating an electric energy to power or energize the other electric parts or elements or facilities of the treadmill.

In accordance with one aspect of the invention, there is provided a treadmill comprising a tread base including a drive roller, and a treadmill belt engaged with the drive roller, and a wheel attached to the drive roller and rotated in concert with the drive roller, and an electric generating device attached to the tread base, and including a spindle, and a fan device attached to the spindle, and the spindle is engaged with the wheel for allowing the spindle of the electric generating device and the fan device to be driven and rotated by the wheel and the drive roller and the treadmill belt without the other electric energy.

The electric generating device includes a sleeve attached onto the spindle for softly or resiliently engaging with the wheel. The electric generating device is preferably attached to the tread base with a supporting bracket.

The electric generating device includes a circuit board electrically coupled to the electric generating device, and includes at least one battery for receiving and storing the electric energy generated by the electric generating device. The electric generating device includes at least one socket attached to the circuit board for charging the other electric parts or elements, such as the portable phones or mobile phones.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
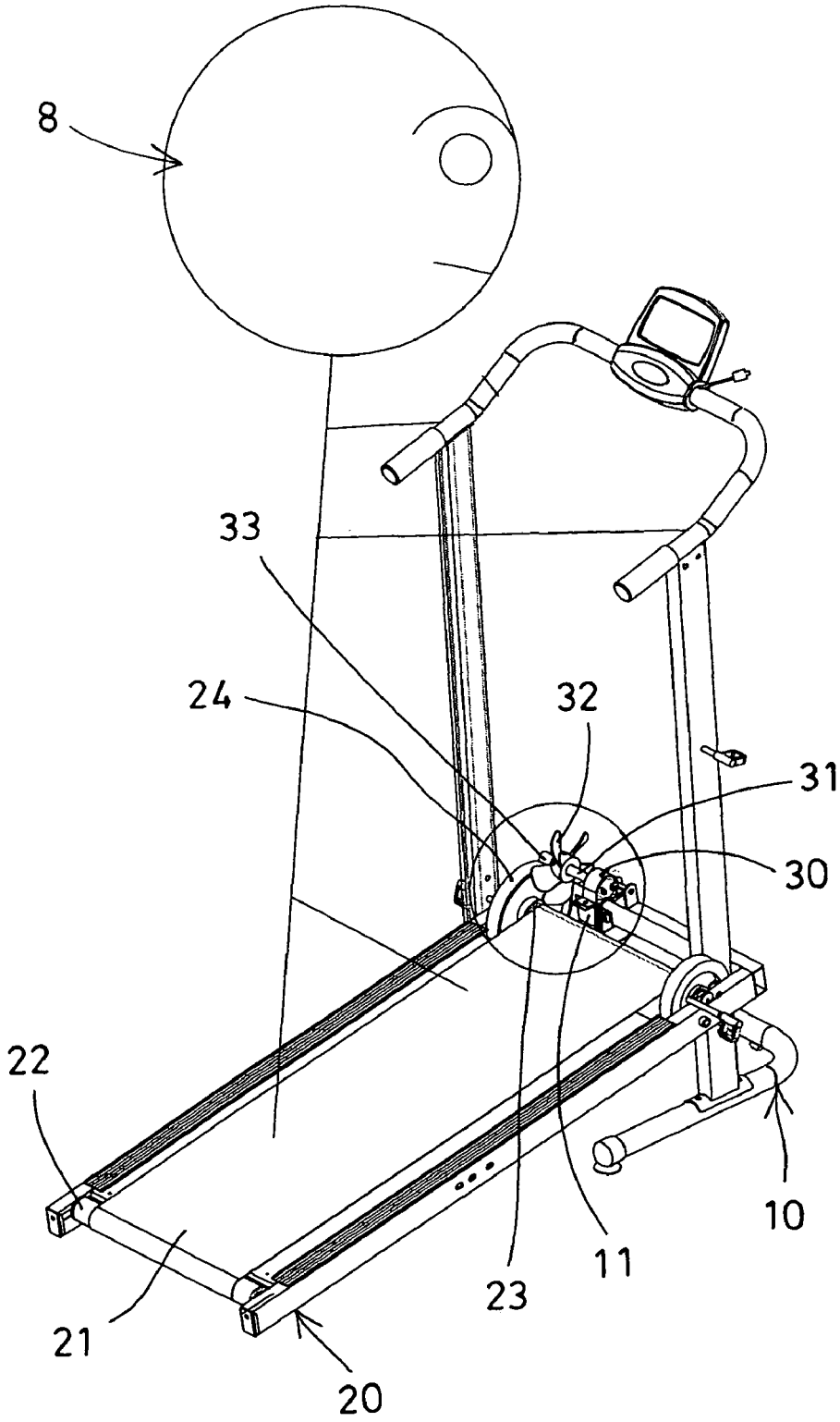
FIG. 1 is a perspective view of a treadmill in accordance with the present invention.
Figure 2:
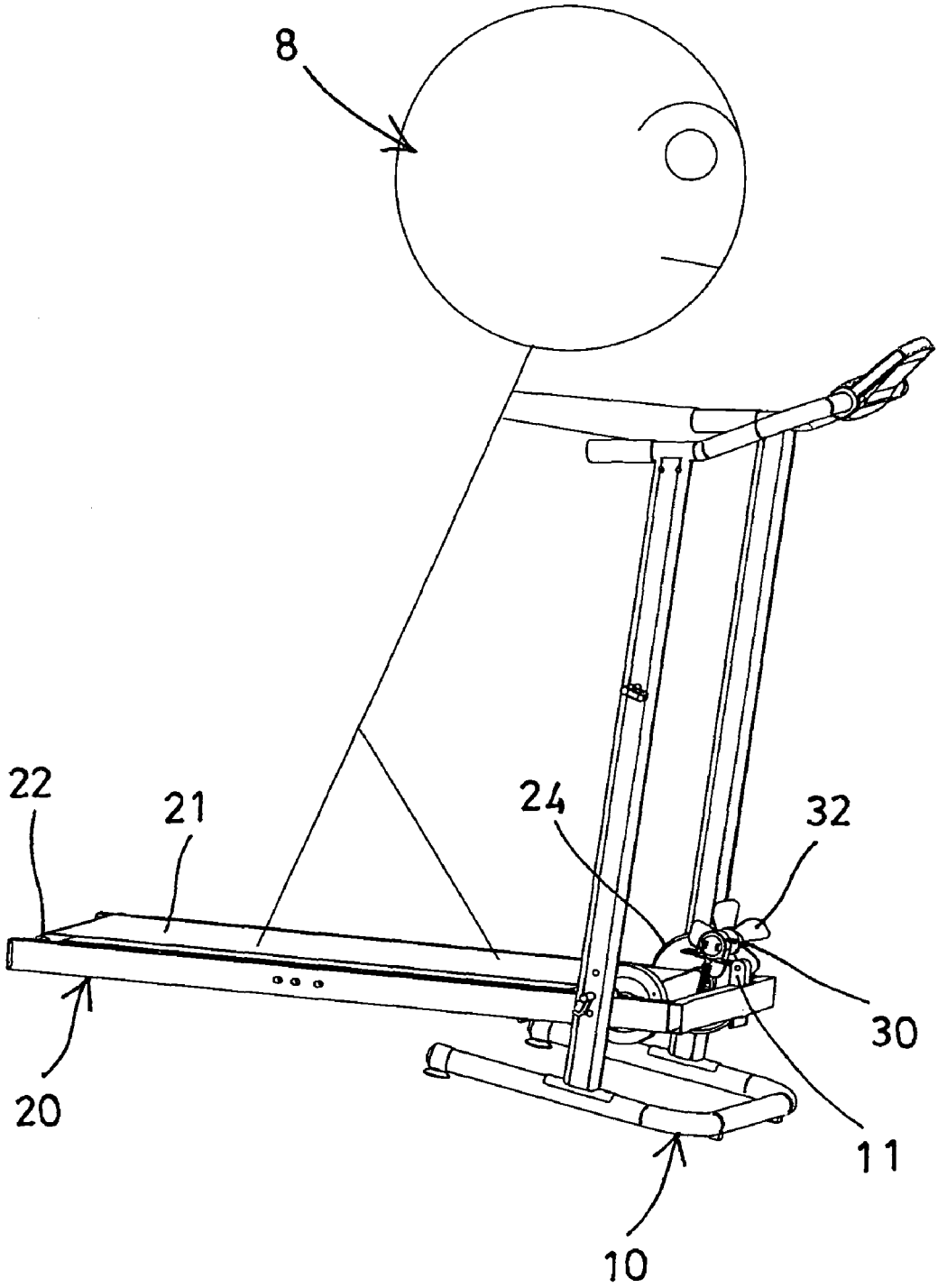
FIG. 2 is another perspective view of the treadmill illustrating the operation of the treadmill.
Figure 3:
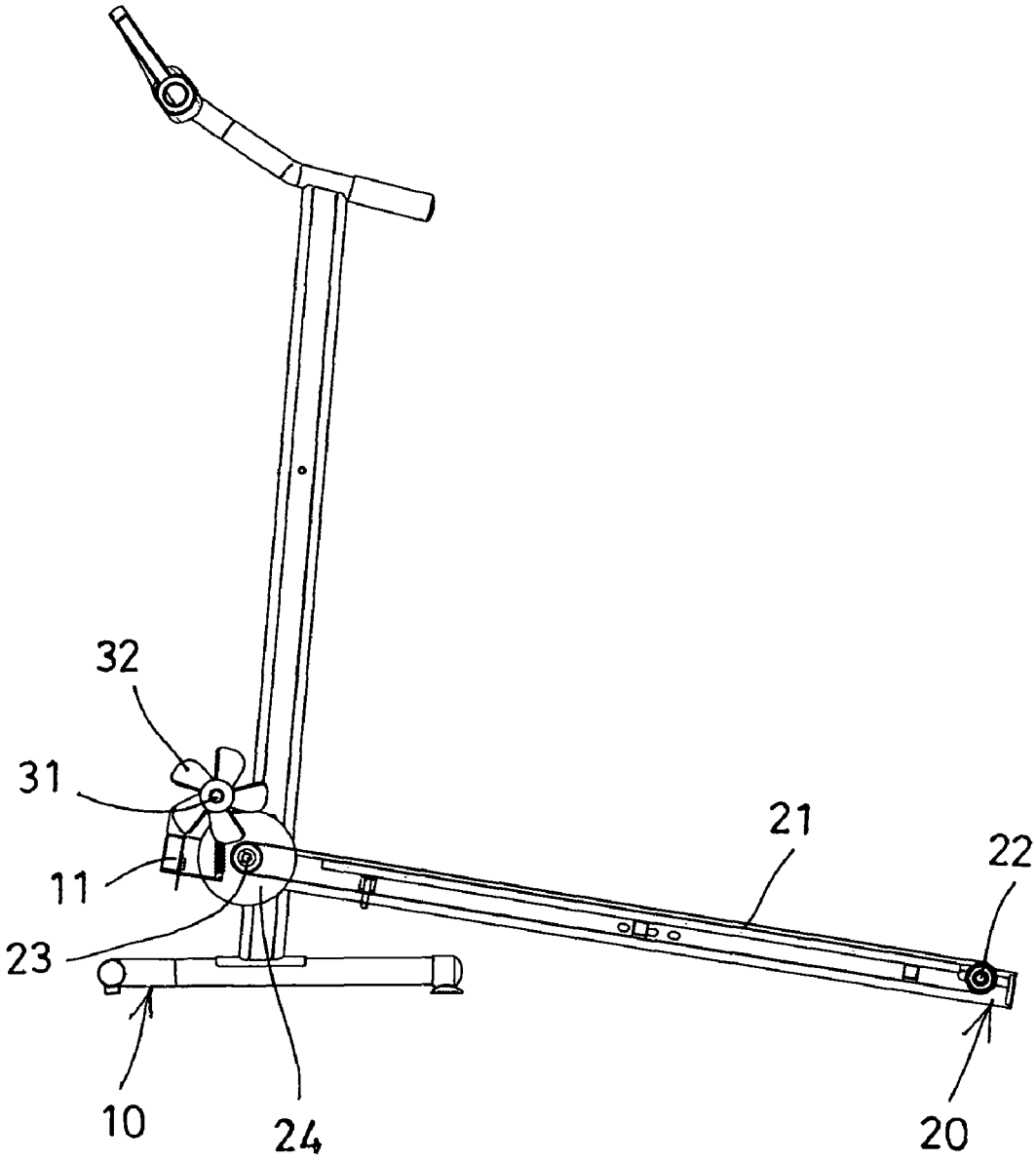
FIG. 3 is a partial side plan schematic view of the treadmill.
Figure 5:
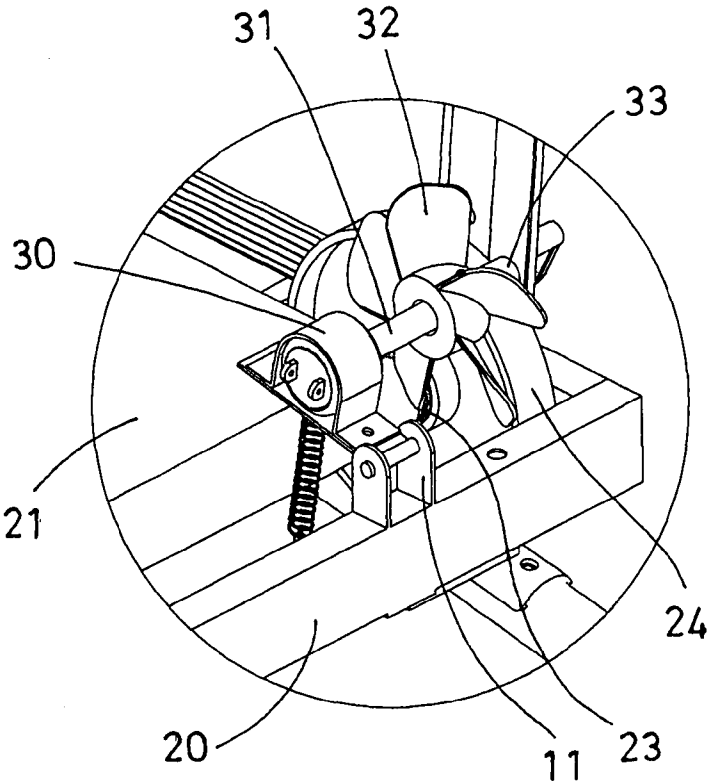
FIG. 5 is another enlarged partial perspective view of the treadmill.
Figure 4:
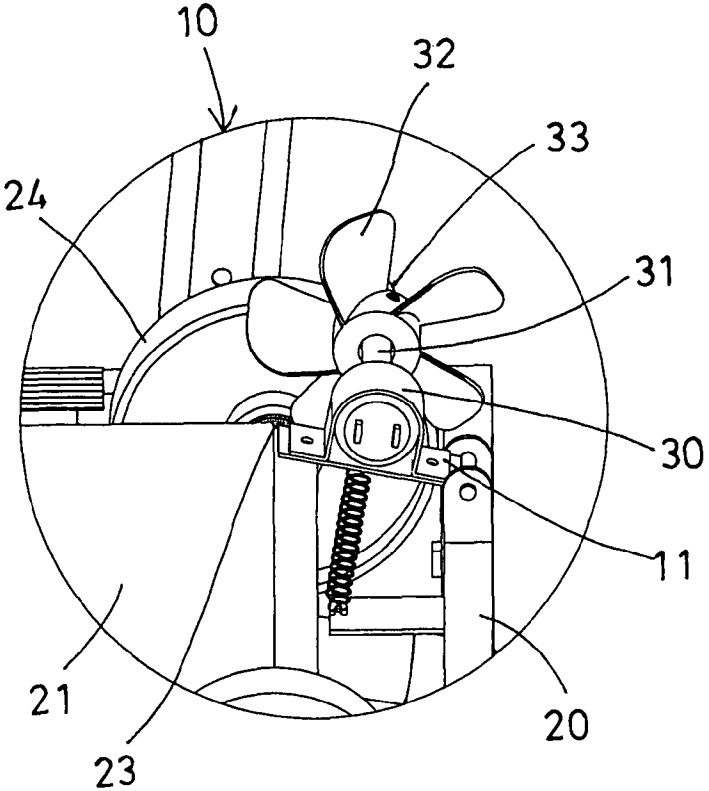
FIG. 4 is an enlarged partial perspective view of the treadmill.
Figure 6:
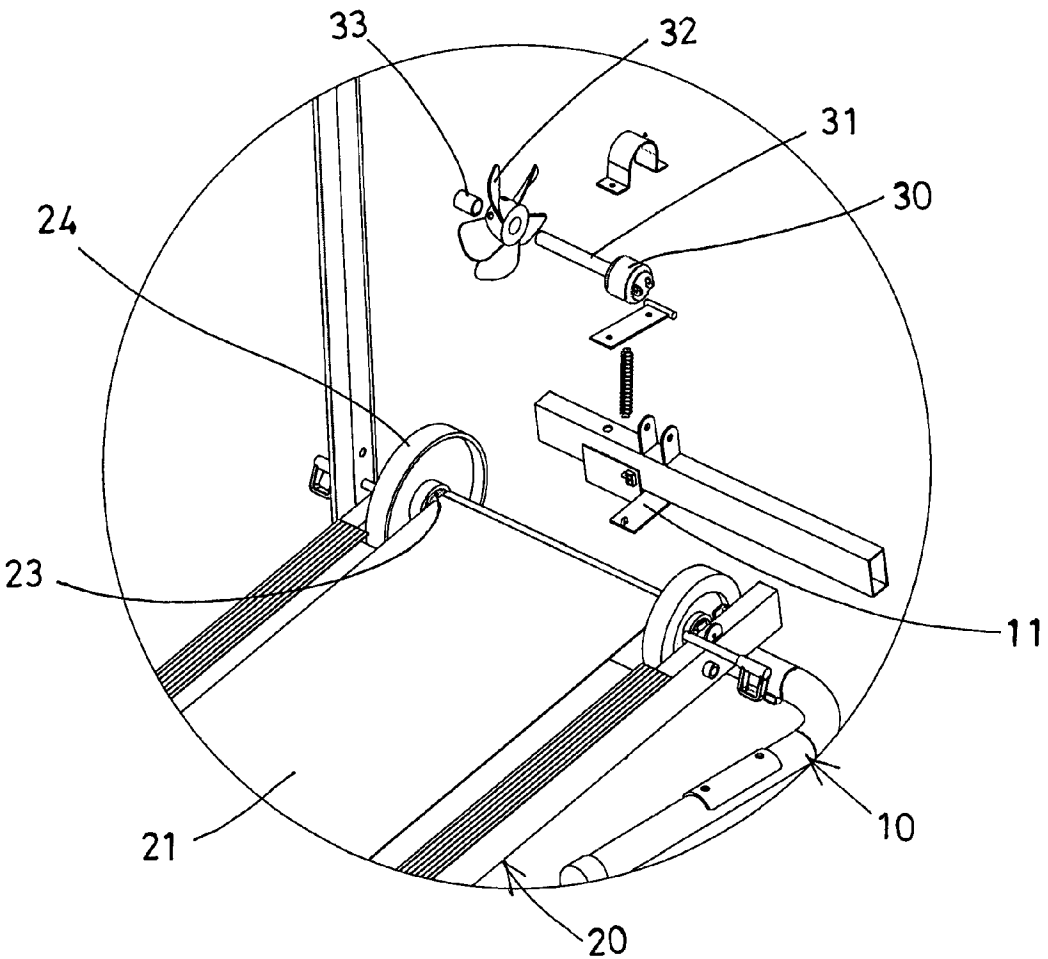
FIG. 6 is an enlarged partial exploded view of the treadmill.

Referring to the drawings, and initially to FIGS. 1-6, a treadmill 1 in accordance with the present invention comprises a supporting base 10, a tread base 20 attached or mounted to the supporting base 10 for pivotally or rotatably supporting a treadmill belt 21 and having a driven or follower roller 22 and a drive roller 23 attached or mounted to the tread base 20 for engaging with the treadmill belt 21 and for suitably supporting the treadmill belt 21 on the tread base 20, and the tread base 20 includes a flywheel or idle wheel 24 attached or mounted to the drive roller 23 and rotated in concert with the drive roller 23.

The treadmill 1 further includes an electric generating device 30 attached or mounted or secured to the tread base 20 with a supporting bracket 11 or the like, and the electric generating device 30 includes a spindle 31, and a fan device 32 attached or mounted or secured to the spindle 31 and rotated in concert with the spindle 31. It is preferable that a soft or resilient rubber or plastic sleeve 33 is further provided and attached or mounted or secured onto the spindle 31 for suitably engaging with the wheel 24 and for allowing the spindle 31 of the electric generating device 30 and the fan device 32 to be suitably driven or rotated by the wheel 24 and the drive roller 23 and the treadmill belt 21. The spindle 31 may also be directly engaged with the wheel 24 without the sleeve 33.

In operation, as also shown in FIGS. 1-5, when the treadmill belt 21 is actuated or operated or rotated or powered around the support rollers 22, 23 by the user 8, the wheel 24 may also be driven or rotated by the drive roller 23 and the treadmill belt 21, and the spindle 31 of the electric generating device 30 may then be driven or rotated by the wheel 24 in order to actuate the electric generating device 30 to generate the electric energy and to power or energize the other electric parts or elements or facilities (not shown) of the treadmill 1, the fan device 32 may also be driven or rotated by the wheel 24 in order to generate a circulating or ventilating air to suitably cool the user 8.

It is to be noted that the electric generating device 30 may be driven or rotated by the wheel 24 in order to generate the electric energy, without being powered or energized by the other electric energy, and the electric energy generated by the electric generating device 30 may be to power or energize the other electric parts or elements or facilities (not shown) of the treadmill 1, in addition, the fan device 32 may also be driven or rotated by the wheel 24 in order to generate a circulating or ventilating air to suitably cool the user 8, without being powered or energized by the other electric energy.

Figure 7:
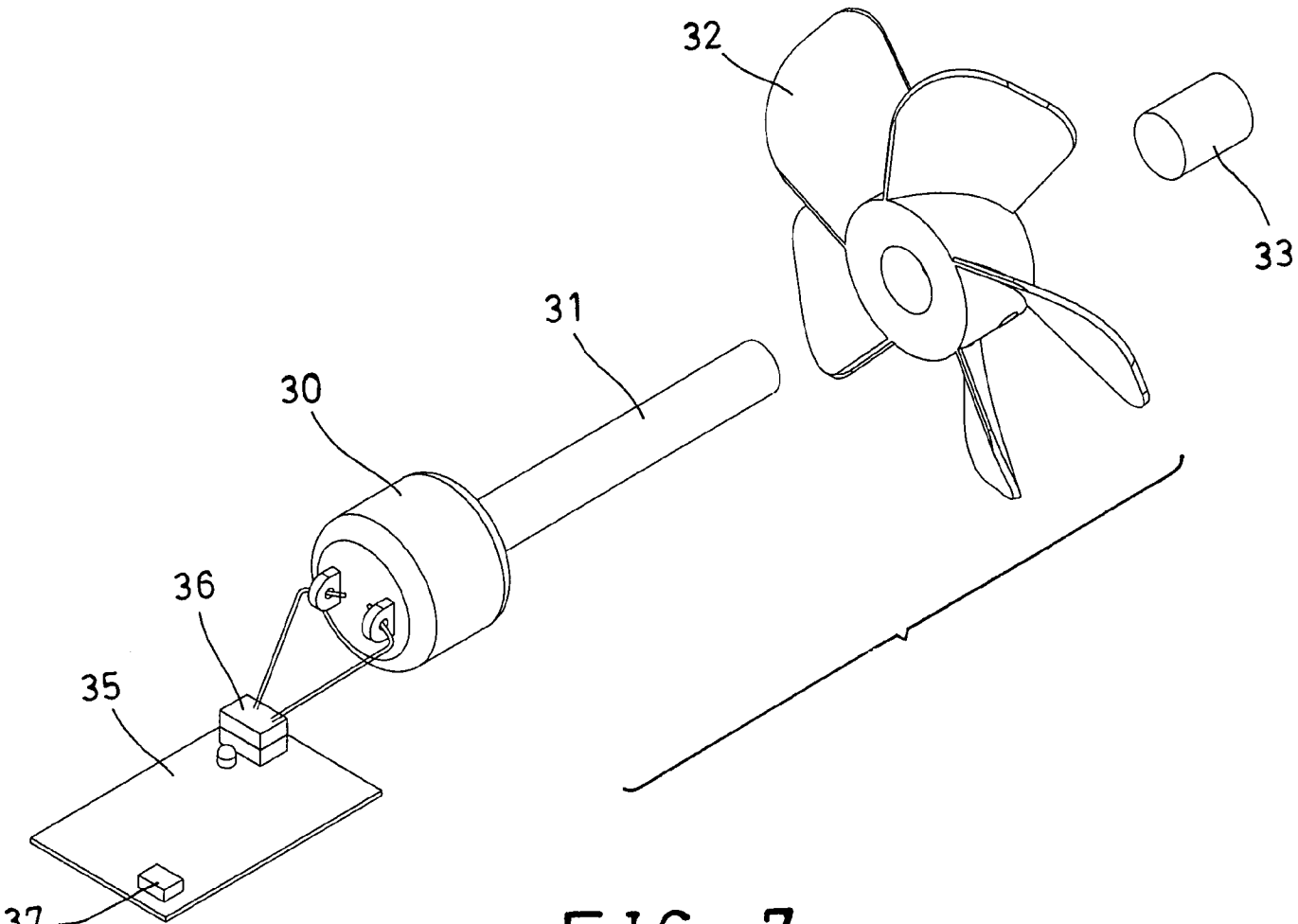
FIG. 7 is another partial exploded view of the treadmill.
Figure 8:
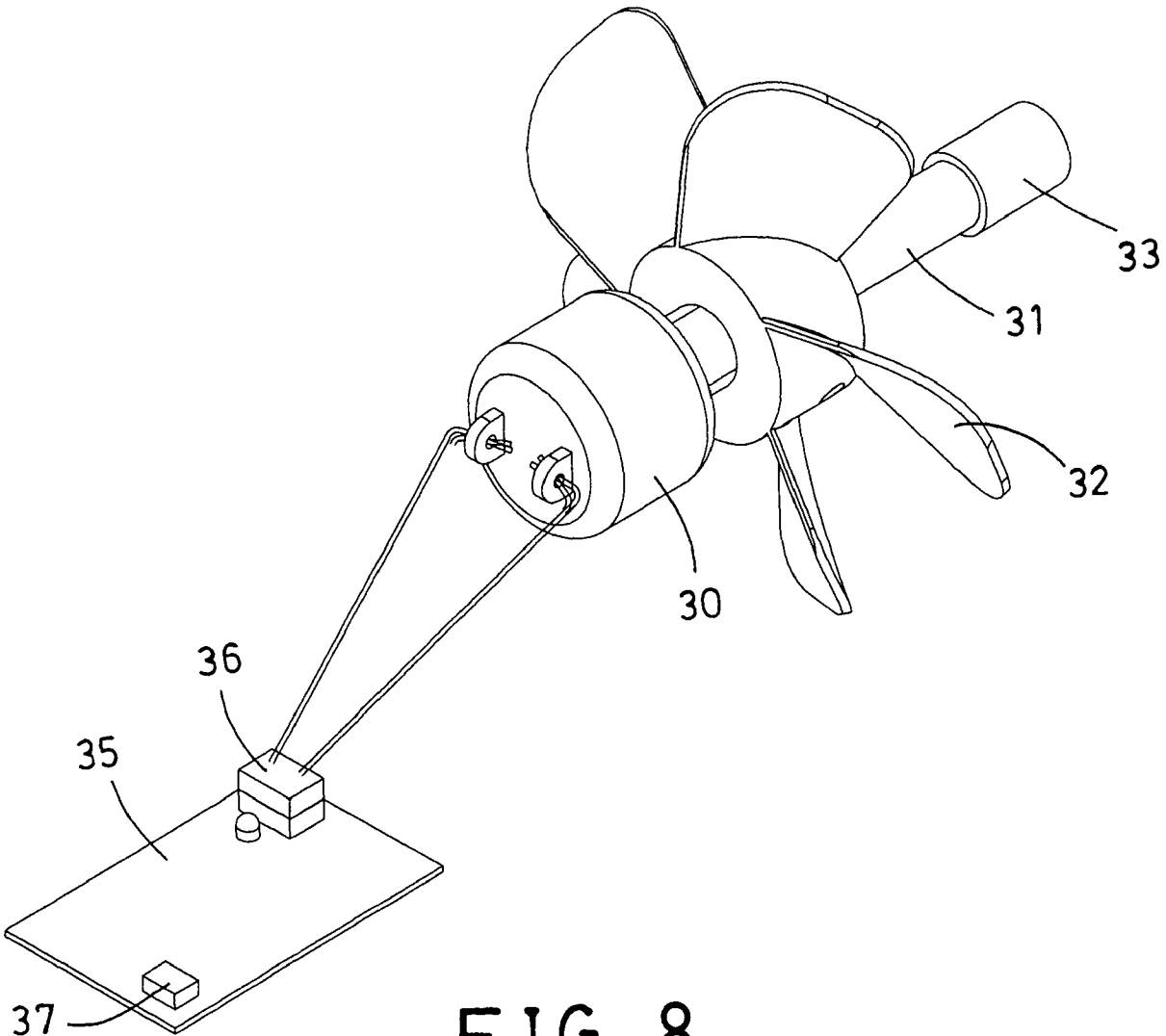
FIG. 8 is an enlarged partial perspective view illustrating the electric generating device and the cooling or ventilating fan device of the treadmill.

As shown in FIGS. 7 and 8, the treadmill 1 may further include an electric circuit board 35 electrically coupled or connected to the electric generating device 30, and includes one or more batteries 36 disposed or attached or mounted or secured onto the circuit board 35 for receiving and storing the electric energy generated by the electric generating device 30, and includes one or more sockets 37 disposed or attached or mounted or secured onto the circuit board 35 for engaging with the other electric parts or elements or facilities (not shown), such as the portable phones or mobile phones (not shown), and for charging the other electric parts or elements or facilities while conducting or operating the treadmill 1.

Accordingly, the treadmill in accordance with the present invention includes a cooling or ventilating fan device driven or rotated or powered by the user without the other electric energy and including an electric generating device for generating an electric energy to power or energize the other electric parts or elements or facilities of the treadmill.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A treadmill comprising:

a tread base including a drive roller, and a treadmill belt engaged with said drive roller, and a wheel attached to said drive roller and rotated in concert with said drive roller, and an electric generating device attached to the tread base, and including a spindle, and a fan device attached to said spindle, and said spindle being engaged with said wheel for allowing said spindle of said electric generating device and said fan device to be driven and rotated by said wheel and said drive roller and said treadmill belt wherein said fan directs airflow towards the user only during exercise usage.

2. The treadmill as claimed in claim 1, wherein said electric generating device includes a sleeve attached onto said spindle for engaging with said wheel.

3. The treadmill as claimed in claim 1, wherein said electric generating device is attached to said tread base with a supporting bracket.

4. The treadmill as claimed in claim 1, wherein said electric generating device includes a circuit board electrically coupled to said electric generating device, and includes at least one battery for receiving and storing the electric energy generated by said electric generating device.

5. The treadmill as claimed in claim 4, wherein said electric generating device includes at least one socket attached to said circuit board.

* * * * *